US010090604B2

(12) United States Patent
Mizuno et al.

(10) Patent No.: US 10,090,604 B2
(45) Date of Patent: Oct. 2, 2018

(54) ANTENNA DEVICE

(71) Applicant: Mitsubishi Electric Corporation, Chiyoda-ku (JP)

(72) Inventors: Tomohiro Mizuno, Chiyoda-ku (JP); Noboru Kawaguchi, Chiyoda-ku (JP); Takashi Takanezawa, Chiyoda-ku (JP); Hidenobu Nishihara, Chiyoda-ku (JP); Hiroto Ado, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days.

(21) Appl. No.: 15/550,088

(22) PCT Filed: Apr. 22, 2016

(86) PCT No.: PCT/JP2016/062738
§ 371 (c)(1),
(2) Date: Aug. 10, 2017

(87) PCT Pub. No.: WO2016/171246
PCT Pub. Date: Oct. 27, 2016

(65) Prior Publication Data

US 2018/0097291 A1 Apr. 5, 2018

(30) Foreign Application Priority Data

Apr. 24, 2015 (JP) ..... 2015-089119

(51) Int. Cl.
*H01Q 19/17* (2006.01)
*H01Q 19/13* (2006.01)
(Continued)

(52) U.S. Cl.
CPC ..... *H01Q 19/13* (2013.01); *H01Q 19/17* (2013.01); *H01Q 19/18* (2013.01)

(58) Field of Classification Search
CPC ..... H01Q 19/10; H01Q 19/17; H01Q 19/19; H01Q 19/192; H01Q 15/14; H01Q 1/288
(Continued)

(56) References Cited

U.S. PATENT DOCUMENTS 3,235,870 A * 2/1966 Hannan ..... H01Q 19/195 343/756
3,898,668 A * 8/1975 Evans ..... F41G 7/2213 342/424
(Continued)

FOREIGN PATENT DOCUMENTS

JP 51-118354 A 10/1976
JP 52-104847 A 9/1977
(Continued)

OTHER PUBLICATIONS

International Search Report dated May 31, 2016, in PCT/JP2016/062738 filed Apr. 22, 2016.

*Primary Examiner* — Hoang Nguyen
*Assistant Examiner* — Awat Salih
(74) *Attorney, Agent, or Firm* — Oblon, McClelland, Maier & Neustadt, L.L.P.

(57) ABSTRACT

An antenna device includes a main-reflector including a main-reflector hole, an additional main-reflector, a sub-reflector, and an additional sub-reflector. The main-reflector surrounds an outer edge of the additional main-reflector, and has a reflective surface on the same side as the additional main-reflector. The sub-reflector faces the main-reflector hole on the reflective surface side of the additional main-reflector, and has a reflective surface facing the reflective surface of the additional main-reflector. The additional sub-reflector surrounds an outer edge of the sub-reflector, and has a reflective surface on the same side as the sub-reflector. The main-reflector reflects an incident electromagnetic wave toward the additional sub-reflector, the additional sub-re-
(Continued)

flector reflects toward the additional main-reflector the electromagnetic wave reflected by the main-reflector, the additional main-reflector reflects toward the sub-reflector the electromagnetic wave reflected by the additional sub-reflector, and the sub-reflector reflects toward the reflector hole the electromagnetic wave reflected by the additional main-reflector.

16 Claims, 12 Drawing Sheets

(51) Int. Cl.
*H01Q 19/18* (2006.01)
*H01Q 19/10* (2006.01)

(58) Field of Classification Search
USPC ..... 343/781 P
See application file for complete search history.

(56) References Cited

U.S. PATENT DOCUMENTS

| | | | | |
|---|---|---|---|---|
| 4,034,378 | A * | 7/1977 | Ohm | H01Q 19/025 343/781 CA |
| 2003/0137466 | A1* | 7/2003 | Yoneda | H01Q 3/08 343/781 P |
| 2015/0311597 | A1* | 10/2015 | Cartaillac | H01Q 19/18 343/836 |

FOREIGN PATENT DOCUMENTS

| | | | |
|---|---|---|---|
| JP | 62-57302 | A | 3/1987 |
| JP | 63-283209 | A | 11/1988 |
| JP | 04-119115 | U1 | 10/1992 |
| JP | 7-135419 | A | 5/1995 |
| JP | 2001-156539 | A | 6/2001 |

* cited by examiner

ANTENNA DEVICE

TECHNICAL FIELD

The present disclosure relates to an antenna device.

BACKGROUND ART

Reflector antennas, including a parabolic antenna, are used in applications such as radio astronomy and satellite communication. Typical types of reflector antennas include multi-reflector antennas. The multi-reflector antenna includes a main-reflector having a central hole, a sub-reflector arranged at the front side of the main-reflector and opposing the hole, and a primary radiator or a beam delivery system arranged at the backside of the main-reflector. The multi-reflector antenna has advantages such as an ability to be used in common for multiple frequencies, and an ability to lower losses by shortening length of the waveguide connected to the receiver-transmitter.

Patent Literature 1 describes multi-reflector antenna device including a main-reflector, a sub-reflector, M (M≥1) focusing reflectors, and a primary radiator. This multi-reflector antenna device includes the sub-reflector and the focusing reflectors between the main-reflector and the primary radiator, to form a wave path for radio waves between the main-reflector and the primary radiator.

CITATION LIST

Patent Literature

Patent Literature 1: Unexamined Japanese Patent Application Kokai Publication No. H7-135419

SUMMARY OF INVENTION

Technical Problem

Outer diameter of the sub-reflector in the multi-reflector antenna is determined on the basis of support structure. Further, for effective utilization of the reflector reflective surface and the beam, the beam diameter of the electromagnetic waves reaching the sub-reflector preferably matches the diameter of the sub-reflector. Thus the conventional multi-reflector antenna has a problem in that, when a subtended angle of the sub-reflector as viewed from the primary radiator is large, an increase is required in the diameter of the beam of electromagnetic waves emitted from the primary radiator.

In consideration of the aforementioned circumstances, an objective of the present disclosure is to provide an antenna device capable of decreasing beam diameter of electromagnetic waves.

Solution to Problem

In order to achieve the aforementioned objective, the antenna device according to the present disclosure includes an additional main-reflector, a main-reflector, a sub-reflector, and an additional sub-reflector. The additional main-reflector has a main-reflector hole. The main-reflector is formed so as to surround an outer edge of the additional main-reflector and has a reflective surface on the same side as that of the additional main-reflector. The sub-reflector is disposed at the reflective-surface side of the additional main-reflector, faces the main-reflector hole, and has a reflective surface facing the reflective surface of the additional main-reflector. The additional sub-reflector is formed so as to surround an outer edge of the sub-reflector and has a reflective surface on the same side as that of the sub-reflector. An electromagnetic wave entering the main-reflector is reflected toward the additional sub-reflector; the electromagnetic wave reflected by the main-reflector is reflected by the additional sub-reflector toward the additional main-reflector; the electromagnetic wave reflected by the additional sub-reflector is reflected by the additional main-reflector toward the sub-reflector; and the electromagnetic wave reflected by the additional main-reflector is reflected by the sub-reflector toward the main-reflector hole.

Advantageous Effects of Invention

According to the present disclosure, the additional main-reflector is provided to the interior of the main-reflector, the additional sub-reflector is provided to the exterior of the sub-reflector, and the electromagnetic wave is reflected by these reflectors, thereby enabling the providing of an antenna device capable of decreasing beam diameter of the electromagnetic wave.

DESCRIPTION OF EMBODIMENTS

Antenna devices of embodiments of the present disclosure are described below in detail in reference to figures.

Embodiment 1

Figure 1:
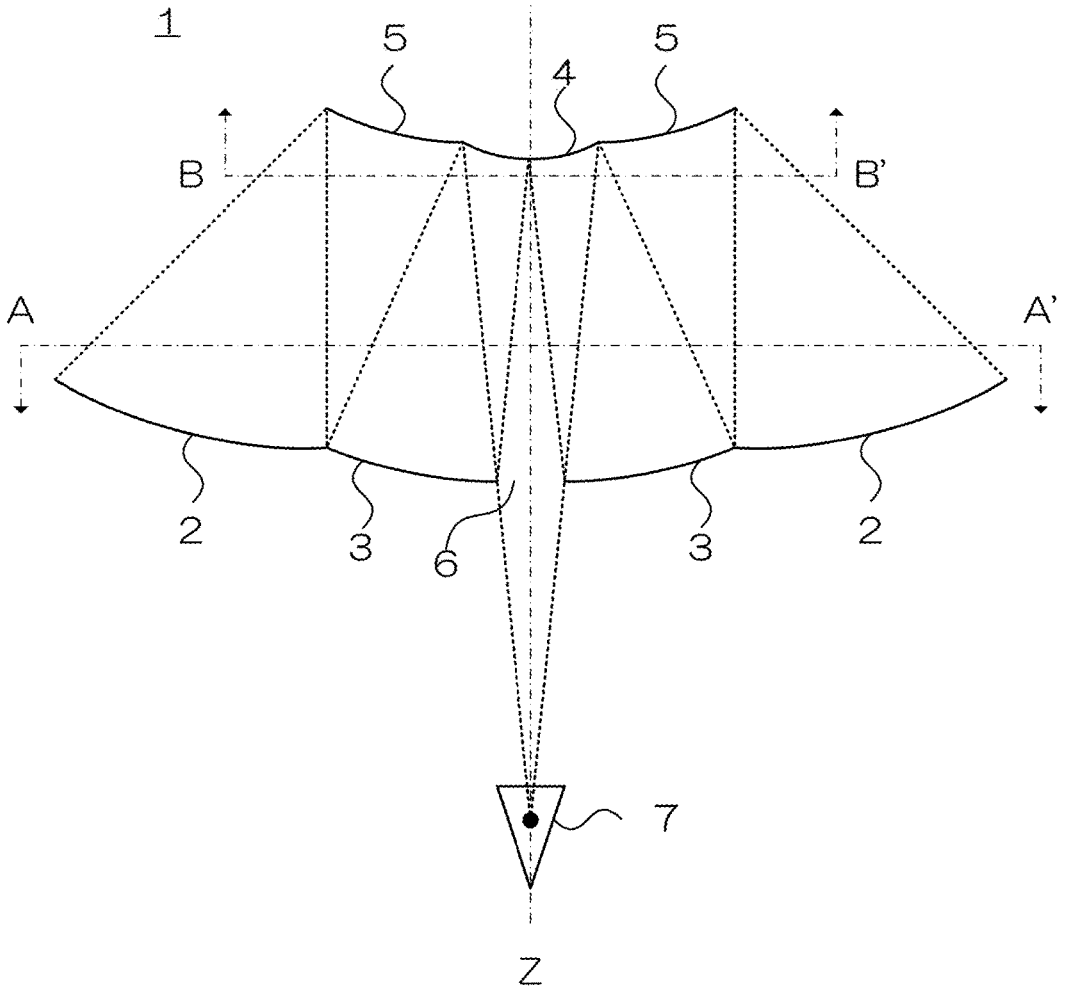
FIG. 1 is a cross-sectional drawing of an antenna device according to Embodiment 1.
Figure 2:
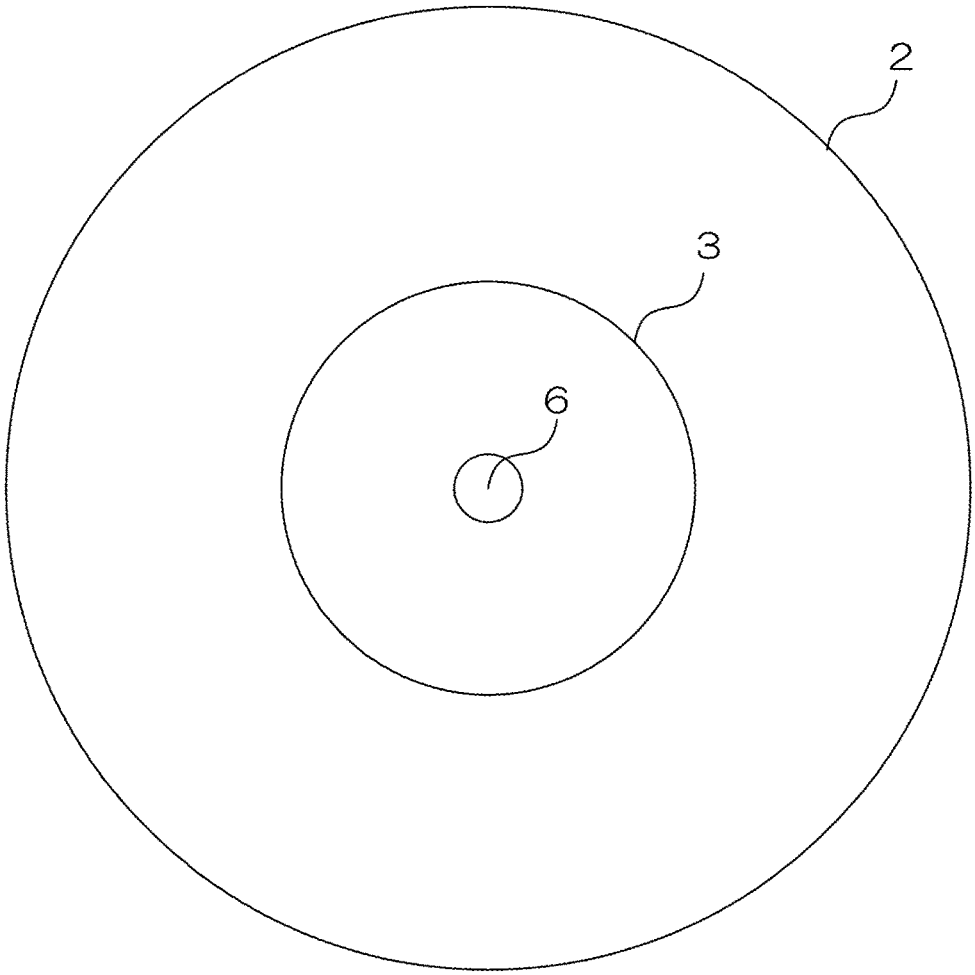
FIG. 2 is a front view of a main-reflector and an additional main-reflector illustrated in FIG. 1.
Figure 3:
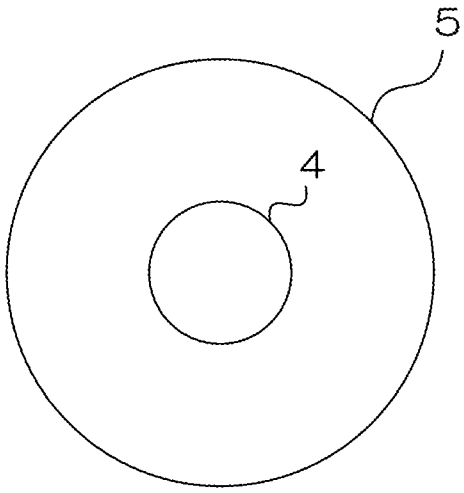
FIG. 3 is a front view of a sub-reflector and an additional sub-reflector illustrated in FIG. 1.

An antenna device 1 according to Embodiment 1 of the present disclosure is described below in reference to FIGS. 1 to 3. FIG. 1 is a cross-sectional drawing illustrating configuration of the antenna device 1. FIG. 2 is a front view, as viewed in the direction of the arrow, of the antenna device 1 at a plane taken perpendicular to the page surface and extending along a line A-A' of FIG. 1. FIG. 3 is a front view, as viewed in the direction of the arrow, of the antenna device 1 at a plane taken perpendicular to the page surface and extending along a line B-B' of FIG. 1. Further, the drawings referred to in the present specification are schematic and do not strictly illustrate reflector curvature and the law of reflection.

Examples of uses of the antenna device 1 include a transmitting antenna emitting an electromagnetic wave for a satellite communication ground station. As illustrated in FIG. 1, the antenna device 1 includes a main-reflector 2, an additional main-reflector 3, a sub-reflector 4, an additional sub-reflector 5, a main-reflector hole 6, and a primary radiator 7.

The main-reflector 2 is a concave reflector and further reflects an electromagnetic wave reflected by the additional sub-reflector 5, thereby determining final direction of the electromagnetic wave emitted by the antenna device 1. As illustrated in FIG. 2, the main-reflector 2 is annular-shaped, has a hole in the center, and surrounds an outer edge of the additional main-reflector 3; and an inner side of the main-reflector 2 connects to the additional main-reflector 3. The main-reflector 2 is formed, for example, from aluminum panels, aluminum vapor-deposited reinforced plastic, or the like. Outer diameter, that is, aperture of the main-reflector 2 is 50 m, for example.

The additional main-reflector 3 is a concave reflector further reflecting to the additional sub-reflector 5 the electromagnetic wave reflected by the sub-reflector 4. As illustrated in FIG. 2, the additional main-reflector 3 has the main-reflector hole 6 at the center and is annular-shaped; and an outer side of the additional main-reflector 3 connects to the main-reflector 2. The additional main-reflector 3 is formed, for example, from aluminum panels, aluminum vapor-deposited reinforced plastic, or the like. Outer diameter of the additional main-reflector 3 is 10 m, for example, and inner diameter, that is, diameter of the main-reflector hole 6, is 1 m, for example.

The sub-reflector 4 is a convex reflector reflecting to the additional main-reflector 3 the electromagnetic wave emitted from the primary radiator 7. The sub-reflector 4 is disposed facing the additional main-reflector 3. As illustrated in FIG. 3, an outer side of the sub-reflector 4 connects to the additional sub-reflector 5. The sub-reflector 4 is formed, for example, from aluminum panels, aluminum vapor-deposited reinforced plastic, or the like. Outer diameter of the sub-reflector 4 is 2 m, for example.

The additional sub-reflector 5 is a convex reflector further reflecting to the main-reflector 2 the electromagnetic wave reflected from the additional main-reflector 3. The additional sub-reflector 5 is arranged facing the main-reflector 2 and the additional main-reflector 3. As illustrated in FIG. 3, the additional sub-reflector 5 has a hole in the center, is annularly-shaped, and surrounds an outer edge of the sub-reflector 4; and an inner side of the additional sub-reflector 5 connects to the sub-reflector 4. The additional sub-reflector 5 is formed, for example, from aluminum panels, aluminum vapor-deposited reinforced plastic, or the like. Outer diameter of the additional sub-reflector 5 is 5 m, for example.

The main-reflector hole 6 is a hole formed in the additional main-reflector 3 for the passage of the electromagnetic wave. The electromagnetic wave emitted from the primary radiator 7 passes through the main-reflector hole 6 and arrives at the sub-reflector 4.

The primary radiator 7 is a radiator emitting the electromagnetic wave, and for example, is a horn antenna. The primary radiator 7 is arranged to the rear of the main-reflector 2 and the additional main-reflector 3, that is to say, is arranged facing the sub-reflector 4 at the side opposite to the side of arrangement of the sub-reflector 4 and the additional sub-reflector 5. An axis interconnecting the center of the primary radiator 7 and the center of the sub-reflector 4 is a beam central axis Z, which is the central axis of the antenna device 1. The beam central axis Z is also referred to simply as the "central axis Z".

The curvature and focal point position of each reflector of the antenna device 1 are described in detail in reference to figures. Further, although each reflector includes a curved surface formed by rotation of a curved line by rotation centered on the beam central axis Z, here the curve is described two-dimensionally in reference to cross-sectional drawings and quadratic curves.

Figure 4:
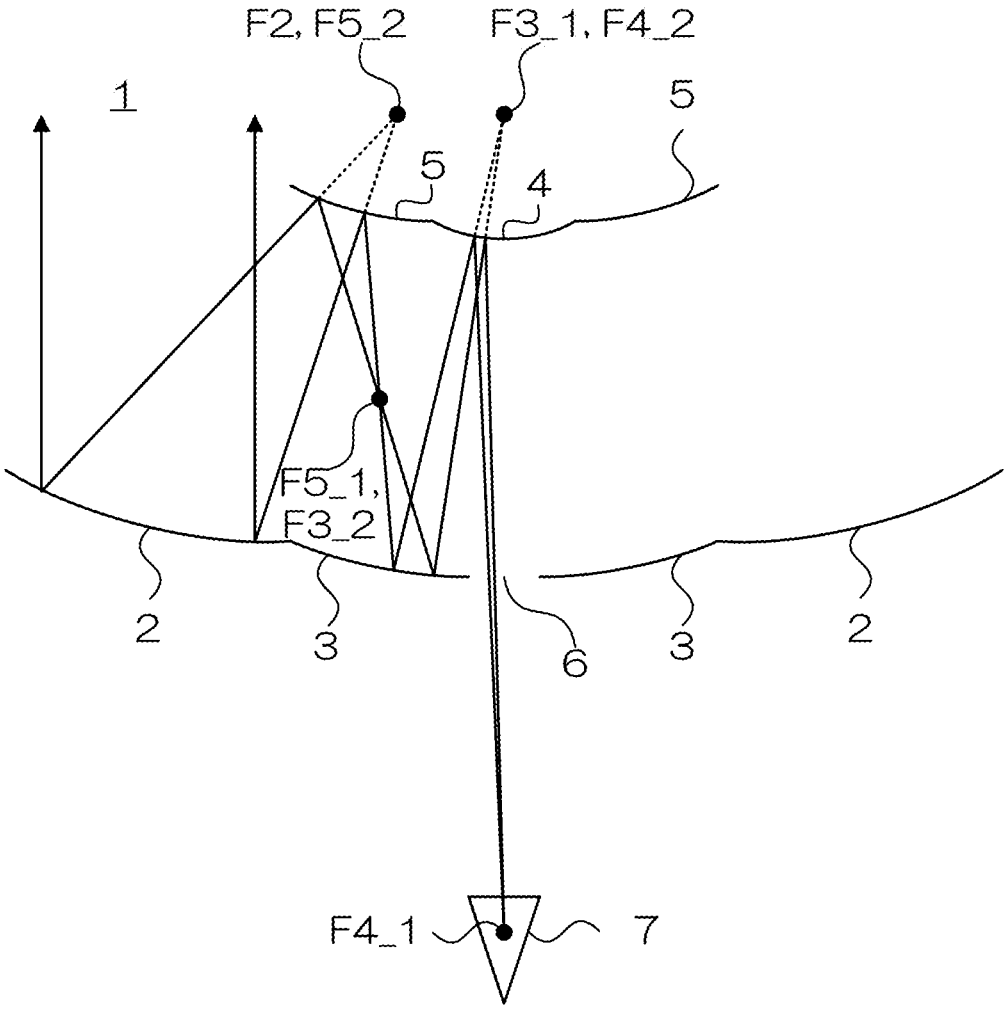
FIG. 4 is a cross-sectional drawing of the antenna device according to Embodiment 1.

FIG. 4 is a cross-sectional drawing illustrating configuration of the antenna device 1 and illustrating each of the reflectors included in the antenna device 1 and the position of the focal point of each reflector. A representative beam is illustrated by arrows.

The reference symbols mentioned in FIG. 4 are described below. The main-reflector 2 has a paraboloid surface formed by rotation of a parabola. Focal point of the parabola is indicated by a reference symbol F2 (main-reflector focal point). The additional main-reflector 3 has an ellipsoid surface formed by rotation of an ellipse. The focal points of this ellipse are indicated by a reference symbol F3_1 (first additional main-reflector focal point) and a reference symbol F3_2 (second additional main-reflector focal point). The sub-reflector 4 has a hyperboloid surface formed by rotation of a hyperbola. The focal points of the hyperbola are indicated by a reference symbol F4_1 (first sub-reflector focal point) and a reference symbol F4_2 (second sub-reflector focal point). The additional sub-reflector 5 has a hyperboloid surface formed by rotation of a hyperbola. The focal points of the hyperbola are indicated by a reference symbol F5_1 (first additional sub-reflector focal point) and a reference symbol F5_2 (second additional sub-reflector focal point).

As illustrated in FIG. 4, the main-reflector 2 has a paraboloid surface formed by rotation of a parabola. The electromagnetic wave reflected by the additional sub-reflector 5 is reflected by the main-reflector 2 in a fixed direction, for example, such as a direction parallel to the beam central axis Z. Thus the main-reflector 2 is disposed such that the point F2, which is the focal point of the main-reflector 2, coincides with the point F5_2, which is one focal point of the additional sub-reflector 5. The placement and the support of the main-reflector 2 and the additional sub-reflector 5 are difficult when the angles between the beam central axis Z and the main-reflector 2 axis and the additional sub-reflector 5 axis are excessively large. To avoid this difficulty, the main-reflector 2 is configured such that the point F2 is offset rather than positioned on the beam central axis Z.

The additional sub-reflector 5 has a hyperboloid surface formed by rotation of a hyperbola. The electromagnetic wave reflected by the additional main-reflector 3 is reflected by the additional sub-reflector 5 toward the main-reflector 2 in a manner as if the electromagnetic wave is emitted from the point F5_2. Thus the additional sub-reflector 5 is disposed such that the point F5_1, which is one focal point of the additional sub-reflector 5, coincides with the point F3_2, which is one focal point of the additional main-reflector 3. Further, the additional sub-reflector 5 is configured such that, when the reflected electromagnetic wave reaches the main-reflector 2, beam diameter of the electromagnetic wave matches the outer diameter of the main-reflector 2.

The additional main-reflector 3 has an ellipsoid surface formed by rotation of an ellipse. The electromagnetic wave reflected by the sub-reflector 4 is reflected by the additional main-reflector 3 toward the additional sub-reflector 5 in a manner as if the electromagnetic wave is emitted from the point F3_2. Thus the additional main-reflector 3 is disposed such that the point F3_1, which is one focal point of the additional main-reflector 3, coincides with the point F4_2, which is one focal point of the sub-reflector 4. Further, the additional main-reflector 3 is configured such that, when the reflected electromagnetic wave reaches the additional sub-reflector 5, beam diameter of the electromagnetic wave matches the outer diameter of the additional sub-reflector 5.

The sub-reflector 4 has a hyperboloid surface formed by rotation of a hyperbola. The sub-reflector 4 reflects the electromagnetic wave emitted from the primary radiator 7 toward the additional main-reflector 3 in a manner as if the electromagnetic wave is emitted from the point F4_2. Thus the sub-reflector 4 is disposed such that the point F4_1, which is one focal point of the sub-reflector 4, coincides with position of the primary radiator 7. Further, the sub-reflector 4 is configured such that, when the reflected electromagnetic wave reaches the additional main-reflector 3, beam diameter of the electromagnetic wave matches the outer diameter of the additional main-reflector 3, and when the electromagnetic wave emitted from the primary radiator 7 reaches the sub-reflector 4, the beam diameter of the electromagnetic wave matches the outer diameter of the sub-reflector 4.

Again in reference to FIG. 1, the details of emission of the electromagnetic wave by the antenna device 1 are described below.

The primary radiator 7 emits the electromagnetic wave toward the sub-reflector 4. The electromagnetic wave emitted from the primary radiator 7 passes through the main-reflector hole 6 and arrives at the sub-reflector 4. Beam diameter of the emitted electromagnetic wave increases with propagation distance, matches the inner diameter of the main-reflector hole 6 when the electromagnetic wave reaches the main-reflector hole 6, and matches the outer diameter of the sub-reflector 4 when the electromagnetic wave reaches the sub-reflector 4.

The electromagnetic wave that arrives at the sub-reflector 4 is reflected by the sub-reflector 4 toward the additional main-reflector 3. The reflected electromagnetic wave arrives at the additional main-reflector 3. Beam diameter of the electromagnetic wave upon arriving at the additional main-reflector 3 matches the outer diameter of the additional main-reflector 3.

The electromagnetic wave arriving at the additional main-reflector 3 is reflected by the additional main-reflector 3 toward the additional sub-reflector 5. The reflected electromagnetic wave arrives at the additional sub-reflector 5. Beam diameter of the electromagnetic wave upon reaching the additional sub-reflector 5 matches the outer diameter of the additional sub-reflector 5.

The electromagnetic wave arriving at the additional sub-reflector 5 is reflected by the additional sub-reflector 5 toward the main-reflector 2. The reflected electromagnetic wave arrives at the main-reflector 2. Beam diameter of the electromagnetic wave upon arriving at the main-reflector 2 matches the outer diameter of the main-reflector 2.

The electromagnetic wave arriving at the main-reflector 2 is reflected by the main-reflector 2 as an electromagnetic wave directed in a direction parallel to the beam central axis Z.

Due to configuration in the aforementioned manner, the antenna device 1 according to the present embodiment includes multiple main-reflectors and multiple sub-reflectors, and beam diameter can be increased by sequential reflection by these reflectors and propagation of the electromagnetic wave emitted from the primary radiator. Thus beam diameter of the electromagnetic wave can be decreased in comparison to a conventional multi-reflector antenna device including a main-reflector having a diameter about the same as that of the main-reflector of the present embodiment and including a sub-reflector having a diameter about the same as the outer diameter of the additional sub-reflector of the present embodiment.

When the beam diameter of the electromagnetic wave emitted from the primary radiator is large, diameter of the hole arranged in the main-reflector increases, and this diameter increase increases the effects of snow accumulation and rain droplets. By decreasing the beam diameter of the electromagnetic wave, size of the main-reflector hole can be decreased, and the effects of snow accumulation and rain droplets can be decreased.

The main-reflector hole is covered by a cover, termed a "feedome", that transmits the electromagnetic wave and improves maintainability. When diameter of the main-reflector hole is large, the main-reflector hole cannot be formed integrally with the feedome, forming of the main-reflector hole and the feedome require interconnecting of materials, and transmittance of the electromagnetic wave is affected. Decreasing of the beam diameter of the electromagnetic wave enables integrated formation of the main-reflector hole with the feedome and enables a decrease in the effect on the electromagnetic wave.

Embodiment 2

Figure 5:
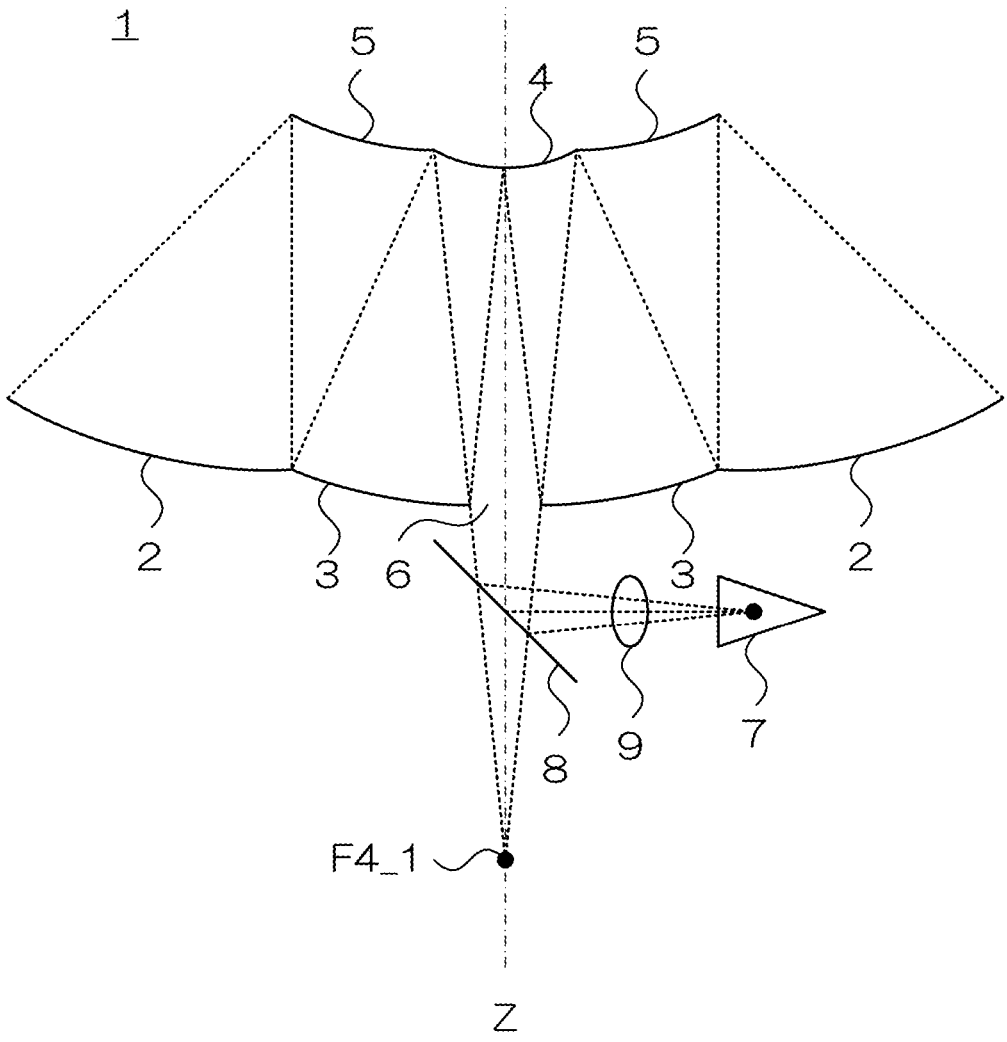
FIG. 5 is a cross-sectional drawing of an antenna device according to Embodiment 2.

The antenna device 1 according to Embodiment 2 of the present disclosure is described below in reference to FIG. 5. FIG. 5 is a cross-sectional drawing illustrating configuration of the antenna device 1. Further, component elements that are the same or equivalent to those of Embodiment 1 are assigned the same reference symbols.

As illustrated in FIG. 5, the antenna device 1 includes a redirecting reflector 8 and a beam transmission hole 9. Further, the primary radiator 7 is disposed facing the redirecting reflector 8.

The electromagnetic wave emitted by the primary radiator 7 is reflected by the redirecting reflector 8 toward the sub-reflector 4. The redirecting reflector 8 is arranged on the beam central axis Z behind the main-reflector 2 and the additional main-reflector 3, that is, at the side opposite to the side at which the sub-reflector 4 and the additional sub-reflector 5 are arranged. The redirecting reflector 8 is arranged such that the electromagnetic wave emitted by the primary radiator 7 and reflected by the redirecting reflector 8 matches an electromagnetic wave emitted from the first sub-reflector focal point F4_1.

The beam transmission hole 9 is a hole for propagation of the electromagnetic wave emitted from the primary radiator 7. Many mechanisms (not illustrated) for supporting and driving the antenna device 1 are arranged behind the main-reflector 2 and the additional main-reflector 3, and the beam transmission hole 9 is formed in each of such mechanisms.

The details of emission of the electromagnetic wave by the antenna device 1 are described below.

The primary radiator 7 emits the electromagnetic wave toward the redirecting reflector 8. The electromagnetic wave emitted from the primary radiator 7 passes through the beam transmission hole 9 and arrives at the redirecting reflector 8.

The electromagnetic wave arriving at the redirecting reflector 8 is reflected by the redirecting reflector 8 toward the sub-reflector 4. The reflected electromagnetic wave passes through the main-reflector hole 6 and arrives at the sub-reflector 4. Beam diameter of the reflected electromagnetic wave increases with propagation distance, matches the inner diameter of the main-reflector hole 6 when the electromagnetic wave reaches the main-reflector hole 6, and matches the outer diameter of the sub-reflector 4 when the electromagnetic wave reaches the sub-reflector 4. Thereafter the details of emission are similar to those in Embodiment 1.

Due to configuration in the aforementioned manner, the antenna device 1 according to the present embodiment can decrease the beam diameter of the electromagnetic wave in a manner similar to that of the antenna device 1 according to Embodiment 1.

The decrease in the beam diameter of the electromagnetic wave enables a decrease in the size of the beam transmission hole and enables a decrease in the effect on the mechanisms used for support and driving. Further, the effect due to beam diameter can be decreased even in the case in which multiple primary radiators are added and a multi-beam is formed.

Embodiment 3

Figure 6:
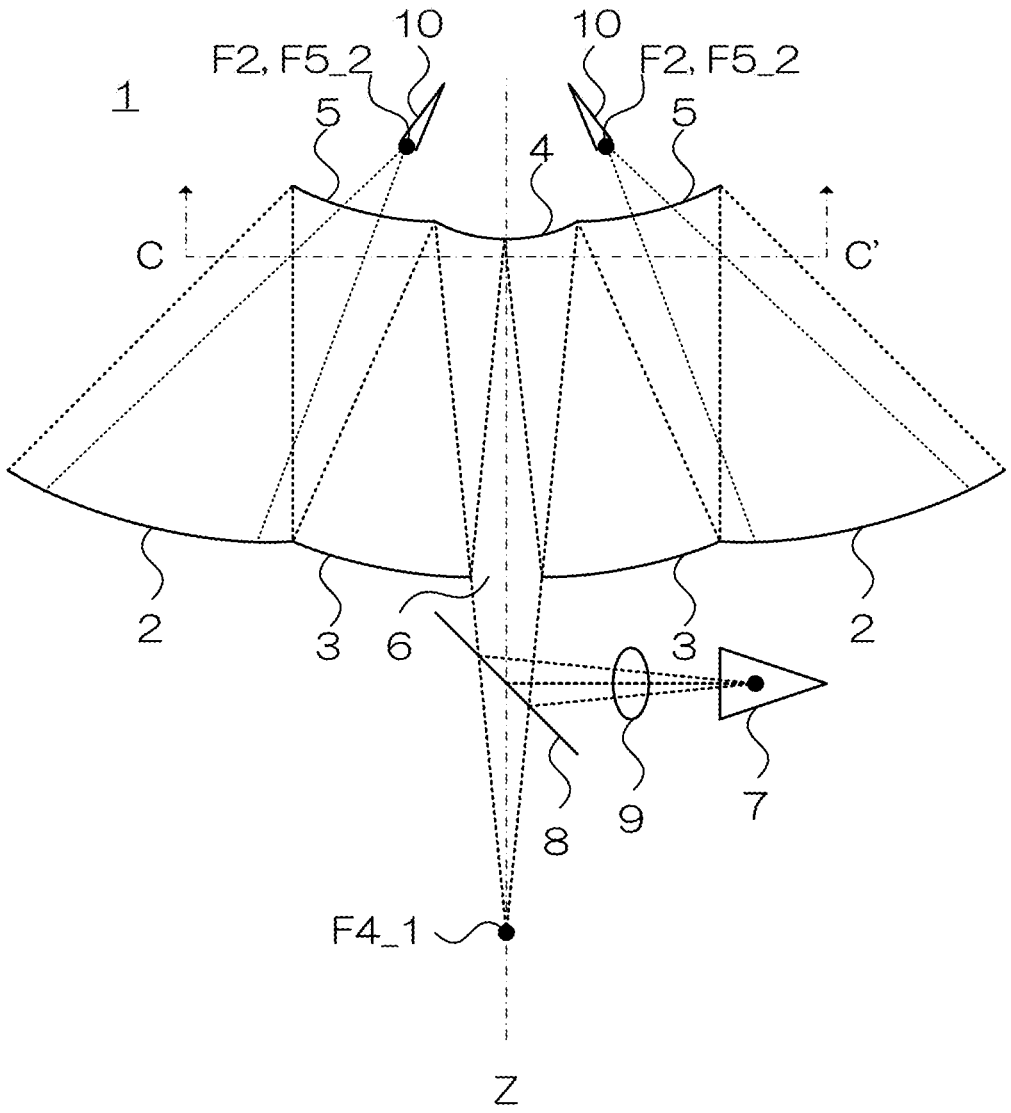
FIG. 6 is a cross-sectional drawing of an antenna device according to Embodiment 3.
Figure 7:
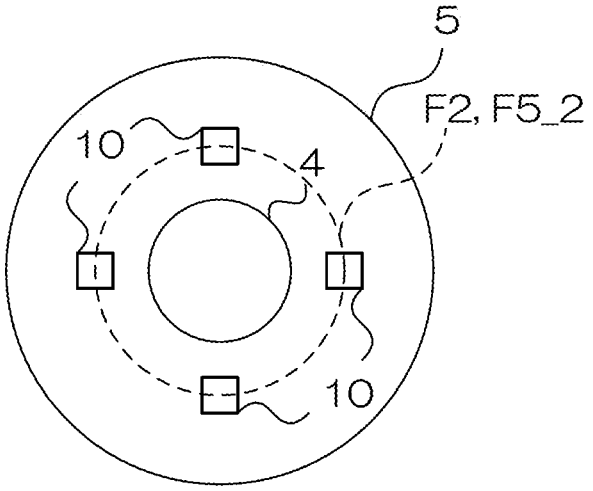
FIG. 7 is a front view of a sub-reflector, an additional sub-reflector, and a sub-radiator illustrated in FIG. 6.

The antenna device 1 according to Embodiment 3 of the present disclosure is described below in reference to FIG. 6 and FIG. 7. FIG. 6 is a cross-sectional drawing illustrating configuration of the antenna device 1. FIG. 7 is a front view, as viewed in the direction of the arrow, of the antenna device 1 at a plane taken perpendicular to the page surface and extending along a line C-C' of FIG. 6. Further, component elements that are the same or equivalent to those of Embodiment 2 are assigned the same reference symbols.

As illustrated in FIG. 7, the antenna device 1 includes, for example, four sub-radiators 10.

The sub-radiator 10 is a radiator that radiates an electromagnetic wave of a frequency different from that of the electromagnetic wave emitted by the primary radiator 7, and the sub-radiator 10 is a horn antenna, for example. The sub-radiators 10 are arranged at the side of the additional sub-reflector 5 opposite to the reflective surface and are arranged 90° apart at positions on the ring-shaped second additional sub-reflector focal point F5_2. The additional sub-reflector 5 reflects the electromagnetic wave of the frequency emitted by the primary radiator 7 and forms a frequency-selective reflective surface passing the electromagnetic wave of the frequencies emitted by the sub-radiators 10.

Due to the sub-radiators 10 emitting the electromagnetic wave that passes through the additional sub-reflector 5 toward the main-reflector 2, the beam formed by the electromagnetic wave emitted by the primary radiator 7 is formed as a beam of different frequencies. Thus in addition to the effects that are similar to those of the antenna device 1 according to Embodiment 2, the antenna device 1 according to the present embodiment achieves the effect of simultaneous transmission of electromagnetic waves of multiple frequencies using a single antenna device 1.

Further, the four sub-radiators 10 are arranged 90° apart, and thus the received signal levels of the sub-radiators 10 can be compared, and phase-comparison mono-pulse tracking can be achieved.

Embodiment 4

Figure 8:
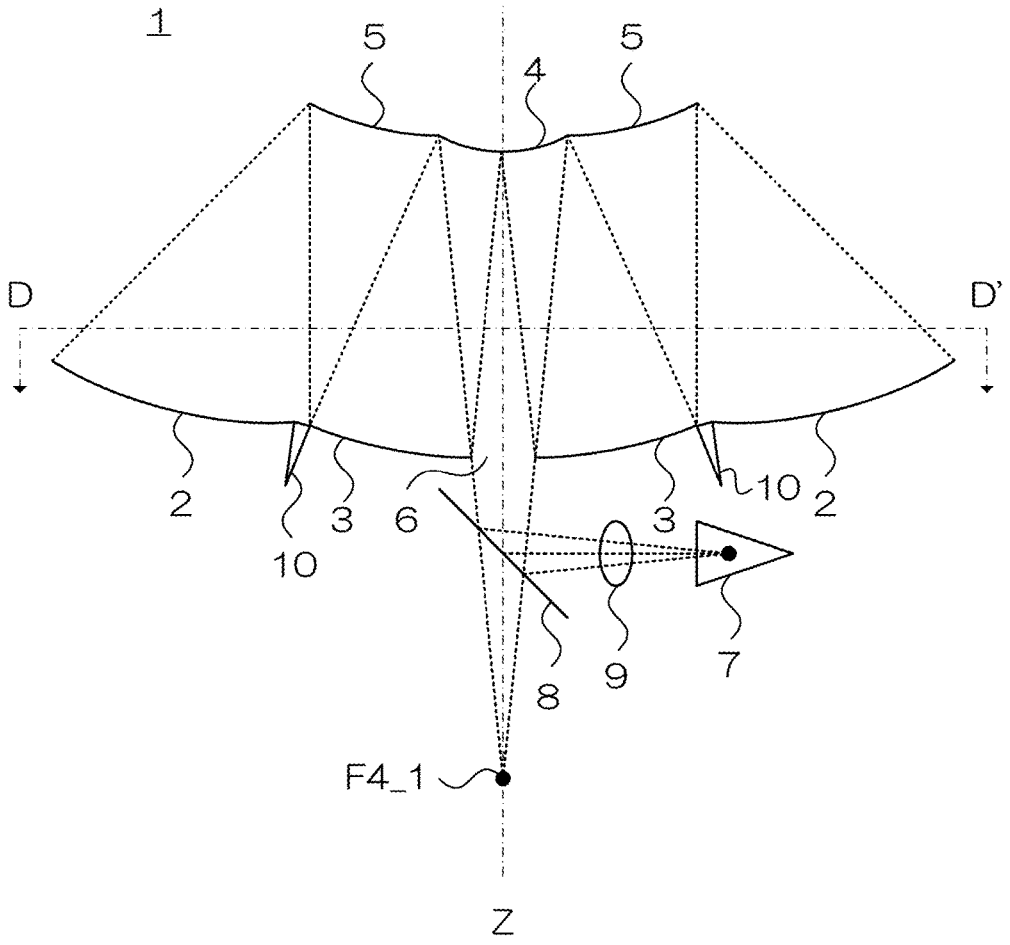
FIG. 8 is a cross-sectional drawing of an antenna device according to Embodiment 4.
Figure 9:
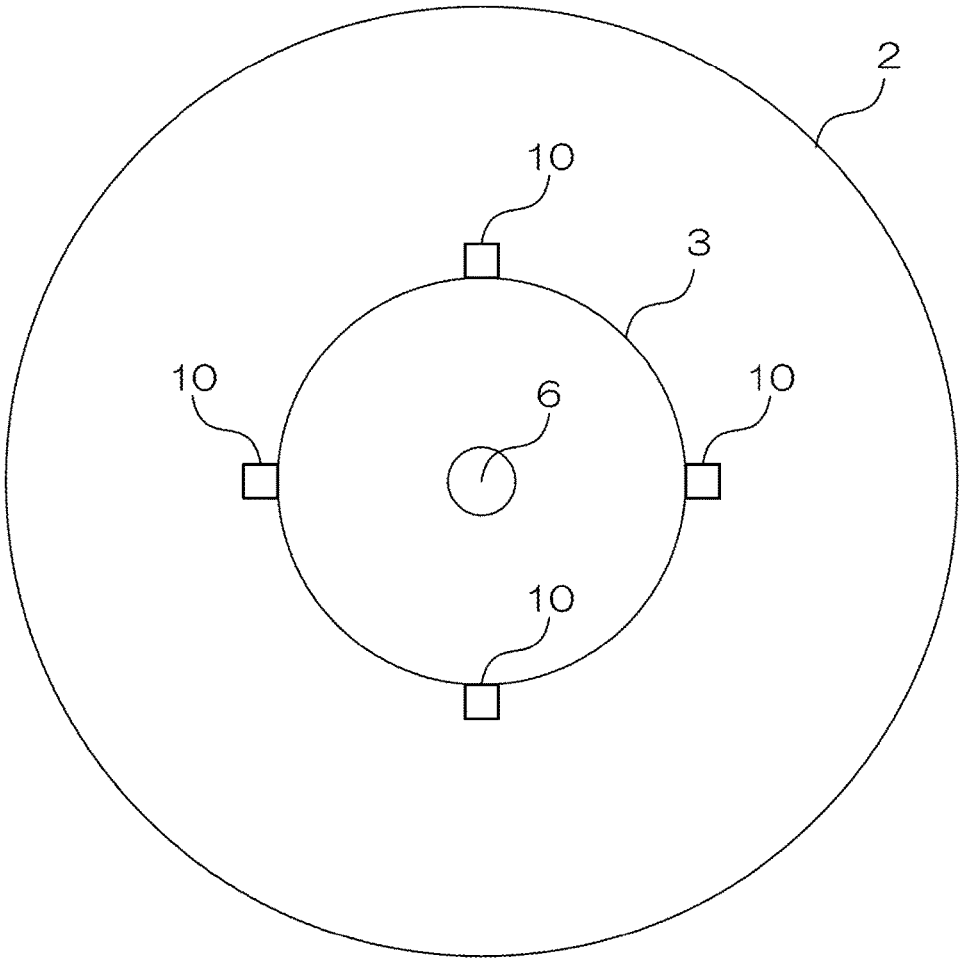
FIG. 9 is a front view of a main-reflector, an additional main-reflector, and a sub-radiator illustrated in FIG. 8.

The antenna device 1 according to Embodiment 4 of the present disclosure is described below in reference to FIG. 8 and FIG. 9. FIG. 8 is a cross-sectional drawing illustrating configuration of the antenna device 1. FIG. 9 is a front view, as viewed in the direction of the arrow, of the antenna device 1 at a plane taken perpendicular to the page surface and extending along a line D-D' of FIG. 8. Further, component elements that are the same or equivalent to those of Embodiment 2 are assigned the same reference symbols.

As illustrated in FIG. 9, the antenna device 1 includes four sub-radiators 10.

In the present embodiment, the sub-radiators 10 are arranged between the main-reflector 2 and the additional main-reflector 3 at positions 90° apart facing the additional sub-reflector 5. In at least one of the main-reflector 2 or the additional main-reflector 3, holes or concavities are formed for disposal of the sub-radiators 10 in order to secure openings for allowing passage of the electromagnetic waves emitted by the sub-radiators 10. The additional sub-reflector 5 reflects both the electromagnetic wave emitted by the primary radiator 7 and the electromagnetic waves emitted by the sub-radiators 10.

The sub-radiator 10 emits the electromagnetic wave toward the additional sub-reflector 5, and the additional sub-reflector 5 reflects the arriving electromagnetic wave toward the main-reflector 2. The main-reflector 2 reflects the arriving electromagnetic waves, and forms a beam of frequencies different from the beam formed by the electromagnetic waves emitted by the primary radiator 7. By this means, the antenna device 1 according to the present embodiment can obtain effects that are similar to those of the antenna device 1 according to Embodiment 3.

Embodiment 5

Figure 10:
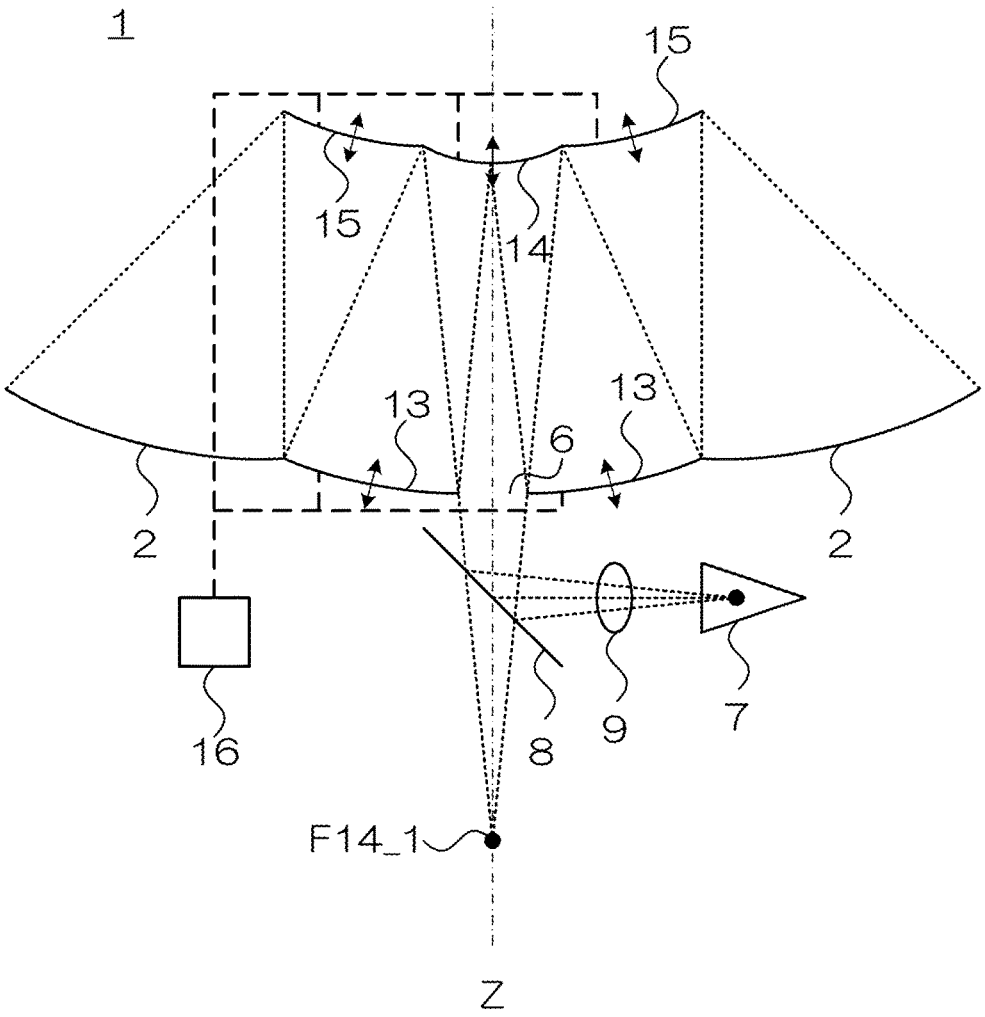
FIG. 10 is a cross-sectional drawing of an antenna device according to Embodiment 5.

The antenna device 1 according to Embodiment 5 of the present disclosure is described below in reference to FIG. 10. FIG. 10 is a cross-sectional drawing illustrating configuration of the antenna device 1. Further, component elements that are the same or equivalent to those of Embodiment 2 are assigned the same reference symbols.

As illustrated in FIG. 10, the antenna device 1 includes a driven additional main-reflector 13, a driven sub-reflector 14, and a driven additional sub-reflector 15, in place of the additional main-reflector 3, the sub-reflector 4, and the additional sub-reflector 5, respectively, of Embodiment 2. Further, the antenna device 1 includes a controller 16.

The driven additional main-reflector 13 is a reflector obtained by adding a drive device capable of changing the position and curvature of the reflector to the additional main-reflector 3 of the other embodiments. The drive device is a combination of motors and gears, for example, that enables changing of the position of the driven additional main-reflector 13 by causing forward and backward movement of the reflector forming the driven additional main-reflector 13. Further, the driven additional main-reflector 13 is formed by reflective surface panels, and each of the reflective surface panels can be moved by the drive device, thereby causes changes in the curvature of the driven additional main-reflector 13. That is to say, the driven additional main-reflector 13 is a reflector capable of changes of position and curvature. The driven sub-reflector 14 and the driven additional sub-reflector 15 have the same capability.

The controller 16 is a computer, for example, and is a control device controlling the driven additional main-reflector 13, the driven sub-reflector 14, and the driven additional sub-reflector 15 and causing changes in the positions and the curvatures of these reflectors.

The controller 16 controls the positions and the curvatures of the driven additional main-reflector 13, the driven sub-reflector 14, and the driven additional sub-reflector 15 so as to move the main-reflector 2-side focal point of the driven sub-reflector 14, that is, so as to move the position of a first driven sub-reflector focal point F14_1. At this time, the controller 16 performs control so as to maintain the relationships between reflectors, and to maintain the relationships between the beam diameters and the diameters of the reflector. For example, there is maintenance of the relationship that is the beam diameter of the electromagnetic wave matching the outer diameter of the main-reflector 2 when the electromagnetic wave reflected by the driven additional sub-reflector 15 arrives at the main-reflector 2.

In other words, the controller 16 controls the positions and the curvatures of the driven additional main-reflector 13, the driven sub-reflector 14, and the driven additional sub-reflector 15 such that the electromagnetic wave emitted from the moved first driven sub-reflector focal point F14_1 is reflected sequentially by the reflectors, is reflected by the main-reflector 2, and is emitted in a direction parallel to the beam central axis Z.

The antenna device 1 according to the present embodiment, in addition to effects similar to those of the antenna device 1 according to Embodiment 2, enables change of the position of the focal point of the driven sub-reflector 14. This ability enables the position of the primary radiator 7, or of a substitute device, to coincide with the focal point of the driven sub-reflector 14 and enables achievement of efficient emission of the electromagnetic wave.

Various types of modifications of the aforementioned embodiments are possible within the scope of the present disclosure. The foregoing embodiments are for the purpose of description, and are not intended to limit the scope of the present disclosure. The scope of the present disclosure is indicated by the attached claims rather than the embodiments. Various modifications made within the scope of the claims or their equivalents are to be included within the scope of the present invention.

For example, although Embodiments 1 to 5 are described by use of a transmitting antenna model in which the antenna device 1 emits the electromagnetic wave, due to reversibility of the antenna, the same effects can be obtained by the same configuration also for a receiving antenna model in which the antenna device 1 receives the electromagnetic wave.

Although the primary radiator 7 emits the electromagnetic wave, this configuration is not limiting. The primary radiator 7 is also an antenna, and due to antenna reversibility, can perform both transmission and reception of the electromagnetic wave. That is to say, the primary radiator 7 functions also as a receiver.

Although the reflectors, including the main-reflector 2, are circular-shaped or annular-shaped, these shapes are not limiting. Shape of the reflector may be elliptical or polygonal. In the present specification, the terms "circular" and "annular" are taken to include elliptical and polygonal shapes, rather than being limited to exactly circular shapes.

Figure 11:
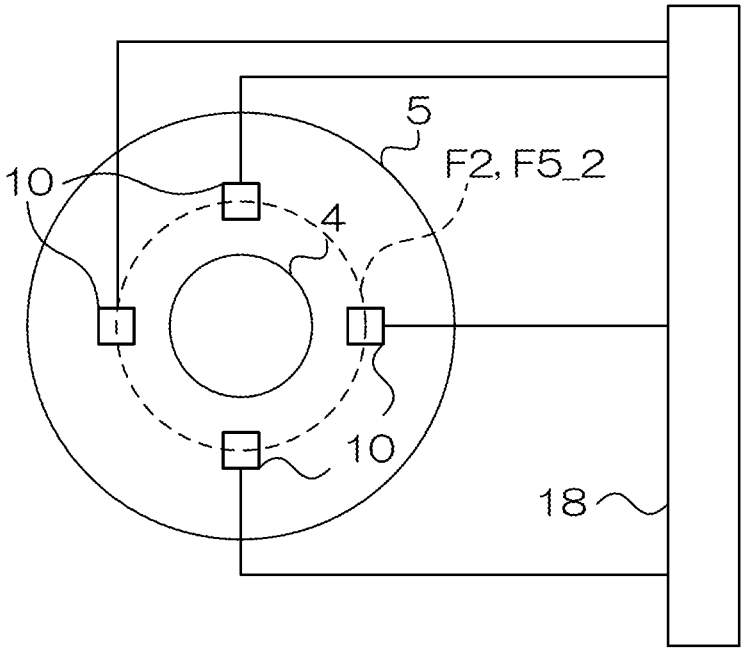
FIG. 11 is a drawing illustrating a sub-reflector, an additional sub-reflector, a sub-radiator, and a distribution circuit in a modified example.

In Embodiments 3 and 4, the antenna device 1 may further include a distribution circuit 18. FIG. 11 is a drawing illustrating the sub-reflector, the additional sub-reflector, the sub-radiator, and the distribution circuit in a modified example. As illustrated in FIG. 11, the distribution circuit 18 is connected to the sub-radiators 10. Use of the distribution circuit 18 to distribute the signal enables the use of the sub-radiators 10 as a single array antenna.

Figure 12:
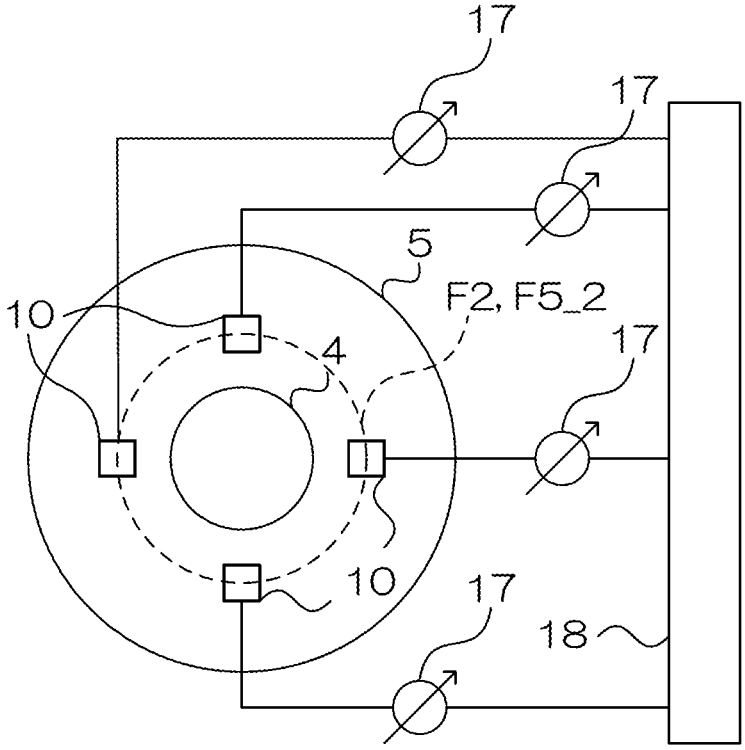
FIG. 12 is a drawing illustrating the sub-reflector, the additional sub-reflector, the sub-radiator, a phase shifter, and the distribution circuit in a modified example.

In Embodiments 3 and 4, the antenna device 1 may further include, in addition to the distribution circuit 18, phase shifters 17. FIG. 12 is a drawing illustrating the sub-reflector, the additional sub-reflector, the sub-radiators, the phase shifters, and the distribution circuit in a modified example. As illustrated in FIG. 12, the distribution circuit 18 is connected via each of the phase shifters 17 to the respective sub-radiator 10. The phase shifters 17 control the excitation phases of the sub-radiators 10. Due to use of the phase shifters 17 to control the excitation phases of the sub-radiators 10, aberrations occurring due to deformation of the main-reflector 2 caused by weight thereof can be corrected for each elevation angle, and this enables suppression of changes of gain that occur due to such gravitational deformation.

In Embodiments 3 and 4, although the antenna device 1 includes four sub-radiators 10, and the sub-radiators 10 are arranged 90° apart, this configuration is not limiting. The number of sub-radiators 10 may be freely selected, and this number may be different from one or four. Furthermore, the position of arrangement may also be freely selected.

In Embodiment 5, although the controller 16 controls the driven additional main-reflector 13, the driven sub-reflector 14, and the driven additional sub-reflector 15 to change the positions and the curvatures of these reflectors, this configuration is not limiting. At least one of the driven additional main-reflector 13, the driven sub-reflector 14, or the driven additional sub-reflector 15 may be controlled, and at least one of the position or the curvature may be changed.

Although the inner side of the main-reflector 2 is connected to the additional main-reflector 3, this configuration is not limiting. There may be a gap between the inner side of the main-reflector 2 and the outer side of the additional main-reflector 3. A similar configuration may be used for the sub-reflector 4 and the additional sub-reflector 5.

Although a Cassegrainian antenna model in which the sub-reflector 4 and the additional sub-reflector 5 are convex reflectors is used in the above description, this configuration is not limiting. For example, a Gregorian antenna model using concave reflectors as the sub-reflector 4 and the additional sub-reflector 5 may be used. Further, the reflectors are not limited to the reflectors described in the embodiments, and reflectors may be used that have a freely selected curvature, including flat reflectors.

Although the antenna device 1 is described as including two main-reflectors and two sub-reflectors, this configuration is not limiting. For example, an antenna device may be formed by including a supplemental main-reflector at the outer side of the main-reflector 2, including a supplemental sub-reflector at the outer side of the additional sub-reflector 5, and by increasing the number of reflections of the electromagnetic wave by two. In this case, the reflector emitting the electromagnetic wave in the direction parallel to the beam central axis Z is the supplemental main-reflector, which is the main-reflector that is the most outwardly arranged. In the same manner, the sets of the main-reflector and the sub-reflector may be further increased.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

This application claims the benefit of Japanese Patent Application No. 2015-089119, filed on Apr. 24, 2015, including the specification, claims, drawings, and abstract, the entire disclosure of which is incorporated by reference herein.

INDUSTRIAL APPLICABILITY

The present disclosure can be used for an antenna device.

REFERENCE SIGNS LIST

1 Antenna device
2 Main reflector
3 Additional main-reflector
4 Sub-reflector
5 Additional sub-reflector
6 Main reflector hole
7 Primary radiator
8 Redirecting reflector
9 Beam transmission hole
10 Sub-radiator
13 Driven additional main-reflector
14 Driven sub-reflector
15 Driven additional sub-reflector
16 Controller
17 Phase shifter
18 Distribution circuit
F2 Main reflector focal point
F3_1 First additional main-reflector focal point
F3_2 Second additional main-reflector focal point
F4_1 First sub-reflector focal point
F4_2 Second sub-reflector focal point
F5_1 First additional sub-reflector focal point
F5_2 Second additional sub-reflector focal point
F14_1 First driven sub-reflector focal point
Z Beam central axis

The invention claimed is:

1. An antenna device comprising:

an additional main-reflector comprising a main-reflector hole and a first reflective surface;

a main-reflector encircling an outer edge of the additional main-reflector and comprising a second reflective surface on the same side as the first reflective surface of the additional main-reflector;

a sub-reflector facing the main-reflector hole, disposed at a side of the first reflective surface of the additional main-reflector, and comprising a third reflective surface facing the first reflective surface of the additional main-reflector; and an additional sub-reflector encircling an outer edge of the sub-reflector, and comprising a fourth reflective surface on the same side as the third reflective surface of the sub-reflector, wherein an electromagnetic wave incident on the main-reflector is reflected by the main-reflector toward the additional sub-reflector, the electromagnetic wave reflected by the main-reflector is reflected by the additional sub-reflector toward the additional main-reflector, the electromagnetic wave reflected by the additional sub-reflector is reflected by the additional main-reflector toward the sub-reflector, and the electromagnetic wave reflected by the additional main-reflector is reflected by the sub-reflector toward the main-reflector hole.

2. The antenna device according to claim 1, further comprising a receiver disposed at a side of the main-reflector and the additional main-reflector opposite to the second reflective surface of the main-reflector and the first reflective surface of the additional main-reflector, wherein the electromagnetic wave reflected by the additional main-reflector passes through the main-reflector hole and is incident on the receiver.

3. The antenna device according to claim 1, wherein a beam diameter of the electromagnetic wave:

matches an outer diameter of the main-reflector when the electromagnetic wave reaches the main-reflector, matches an outer diameter of the additional sub-reflector when the electromagnetic wave reaches the additional sub-reflector, matches an outer diameter of the additional main-reflector when the electromagnetic wave reaches the additional main-reflector, matches an outer diameter of the sub-reflector when the electromagnetic wave reaches the sub-reflector, and matches an outer diameter of the main-reflector hole when the electromagnetic wave reaches the main-reflector hole.

4. The antenna device according to claim 1, wherein the second reflective surface of the main-reflector has a paraboloid surface defined by rotation of a portion of a parabola around a central axis, the parabola having as a focal point a main-reflector focal point, the first reflective surface of the additional main-reflector has an ellipsoid shape defined by rotation of a portion of an ellipse around the central axis, the ellipse having as focal points a first additional main-reflector focal point and a second additional main-reflector focal point, the third reflective surface of the sub-reflector has a hyperboloid shape defined by rotation of a portion of a hyperbola around the central axis, the hyperbola having as focal points a sub-reflector focal point and the first additional main-reflector focal point, the fourth reflective surface of the additional sub-reflector has a hyperboloid shape defined by rotation of a portion of a hyperbola around the central axis, the hyperbola having as focal points the main-reflector focal point and the second additional main-reflector focal point, and the central axis passes through the sub-reflector focal point and the first additional main-reflector focal point.

5. The antenna device according to claim 1, further comprising a controller to change a curvature of at least one of the additional main-reflector, the sub-reflector, or the additional sub-reflector.

6. The antenna device according to claim 1, further comprising a set of a supplemental main-reflector encircling an outer edge of the main-reflector, and a supplemental sub-reflector encircling an outer edge of the additional sub-reflector.

7. The antenna device according to claim 1, wherein a shape of the first reflective surface of the main-reflector is different than a shape of the second reflective surface of the additional main-reflector.

8. An antenna device comprising:

an additional main-reflector comprising a main-reflector hole and a first reflective surface;

a main-reflector encircling an outer edge of the additional main-reflector and comprising a second reflective surface on the same side as the first reflective surface of the additional main-reflector;

a sub-reflector facing the main-reflector hole, disposed at a side of the first reflective surface of the additional main-reflector, and comprising a third reflective surface facing the first reflective surface; and an additional sub-reflector encircling an outer edge of the sub-reflector, and comprising a fourth reflective surface on the same side as the third reflective surface of the sub-reflector, wherein an electromagnetic wave passing through the main-reflector hole is reflected by the sub-reflector toward the additional main-reflector, the electromagnetic wave reflected by the sub-reflector is reflected by the additional main-reflector toward the additional sub-reflector, and the electromagnetic wave reflected by the additional main-reflector is reflected by the additional sub-reflector toward the main-reflector.

9. The antenna device according to claim 8, further comprising a primary radiator disposed at a side of the main-reflector and the additional main-reflector opposite to the second reflective surface of the main-reflector and the first reflective surface of the additional main-reflector, wherein the electromagnetic wave emitted from the primary radiator passes through the main-reflector hole and is reflected by the sub-reflector.

10. The antenna device according to claim 9, wherein the primary radiator is disposed facing the main-reflector hole and emits the electromagnetic wave toward the main-reflector hole.

11. The antenna device according to claim 9, further comprising a redirecting reflector disposed at a side of the main-reflector and the additional main-reflector opposite to the second reflective surface of the main-reflector and the first reflective surface of the additional main-reflector, wherein the primary radiator is disposed facing the redirecting reflector and emits the electromagnetic wave toward the redirecting reflector, and the electromagnetic wave emitted from the primary radiator is reflected by the redirecting reflector toward the main-reflector hole.

12. The antenna device according to claim 8, further comprising a sub-radiator at a side of the additional sub-reflector opposite to the fourth reflective surface of the additional sub-reflector, wherein the additional sub-reflector transmits the electromagnetic wave emitted from the sub-radiator.

13. The antenna device according to claim 12, further comprising a distribution circuit to distribute a signal to the sub-radiator.

14. The antenna device according to claim 13, further comprising a phase shifter to control an excitation phase of the sub-radiator.

15. The antenna device according to claim 8, further comprising a sub-radiator between the main-reflector and the additional main-reflector.

16. The antenna device according to claim 8, wherein a shape of the first reflective surface of the main-reflector is different than a shape of the second reflective surface of the additional main-reflector.

* * * * *